US010205306B2

(12) United States Patent
Okuda et al.

(10) Patent No.: US 10,205,306 B2
(45) Date of Patent: Feb. 12, 2019

(54) METHOD FOR PRODUCING SPARK PLUG

(71) Applicant: NGK SPARK PLUG CO., LTD., Nagoya-shi, Aichi (JP)

(72) Inventors: Masafumi Okuda, Nagoya (JP); Toshiyuki Otsuki, Komaki (JP); Kanako Nishiyama, Kasugai (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/693,660

(22) Filed: Sep. 1, 2017

(65) Prior Publication Data

US 2018/0069379 A1 Mar. 8, 2018

(30) Foreign Application Priority Data

Sep. 7, 2016 (JP) ..... 2016-174857
May 11, 2017 (JP) ..... 2017-095100

(51) Int. Cl.
*H01T 13/60* (2011.01)
*H01T 21/02* (2006.01)
*H01T 13/38* (2006.01)

(52) U.S. Cl.
CPC ..... *H01T 13/60* (2013.01); *H01T 21/02* (2013.01); *H01T 13/38* (2013.01)

(58) Field of Classification Search
CPC ..... H01T 13/60; H01T 21/02
USPC ..... 445/3
See application file for complete search history.

(56) References Cited

U.S. PATENT DOCUMENTS 4,701,662 A * 10/1987 Yamanashi ..... H01T 13/04 313/135
2014/0065915 A1* 3/2014 Kyuno ..... H01T 13/58 445/7
2014/0141679 A1* 5/2014 Kyuno ..... H01T 21/02 445/3

FOREIGN PATENT DOCUMENTS

JP S49-067821 A 7/1974
JP H08-130131 A 5/1996
JP 2013-089428 A 5/2013

OTHER PUBLICATIONS

Office Action issued in corresponding Japanese Patent Application No. 2017-095100 dated Jun. 26, 2018 with English-language machine translation.

* cited by examiner

*Primary Examiner* — Donald L Raleigh
(74) *Attorney, Agent, or Firm* — Kusner & Jaffe

(57) ABSTRACT

A method for producing a spark plug, including an inspection step for an insulator includes: (a) a step of preparing an assembly; (b) a step of attaching the assembly to a pressure vessel; (c) a step of attaching an insulating member to the assembly so as to cover at least a part of a surface of a portion of the insulator that is exposed at the rear side; and (d) a step of pressurizing an interior of the pressure vessel and applying a predetermined voltage between the metal terminal and the metal shell. The producing method further includes a step of adhering a lubricant to at least one of a surface of the insulator and an inner surface of the insulating member.

6 Claims, 8 Drawing Sheets

METHOD FOR PRODUCING SPARK PLUG

RELATED APPLICATIONS

This application claims the benefit of Japanese Patent Application No. 2016-174857, filed Sep. 7, 2016, and Japanese Patent Application No. 2017-095100, filed May 11, 2017, the entire contents of which are incorporated herein by reference.

FIELD OF THE INVENTION

The present invention relates to production of a spark plug to be used for ignition in an internal combustion engine or the like.

BACKGROUND OF THE INVENTION

Japanese Patent Application Laid-Open (kokai) No. 2013-89428 discloses a method for inspecting the dielectric strength of an insulator of a spark plug. In this inspection method, in an assembly obtained by assembling a metal shell, a metal terminal, a center electrode, and an insulator, a voltage is applied between the metal terminal and the metal shell. When a defect such as cracking is present in the insulator, a current flows via the defect, and thus a voltage that can be applied is decreased. Therefore, when the applied voltage exceeds a predetermined value, the dielectric strength of the insulator is determined as good, and when the applied voltage is equal to or less than the predetermined value, the dielectric strength of the insulator is determined as not good. In this inspection method, application of the voltage is performed in a state where a rear end portion of the insulator is covered with a cylindrical insulating member having an electrical insulation property. Accordingly, a phenomenon in which a current flows between the metal terminal and the metal shell through the vicinity of the rear end of the insulator (also referred to as flash over phenomenon) can be inhibited, and thus a situation where dielectric strength cannot be inspected can be avoided.

In this respect, a flash over phenomenon can be inhibited more as the insulating member is more strongly brought into close contact with the insulator. However, when the insulating member is strongly brought into close contact with the insulator, it becomes difficult to detach the insulating member from the insulator after inspection, so that there is a possibility that smooth progress of the inspection is hindered.

The present specification discloses a technology that allows inspection of an insulator of a spark plug to smoothly progress while inhibiting a flash over phenomenon during the inspection.

SUMMARY OF THE INVENTION

The technology disclosed in the present specification can be embodied in the following Application Examples.

APPLICATION EXAMPLE 1

In accordance with a first aspect of the present invention, there is provided a method for producing a spark plug, the method including an inspection step for an insulator, wherein the inspection step for the insulator includes (a) a step of preparing an assembly including: a tubular metal shell that has a through hole extending in an axial direction; the insulator that is partially held within the through hole, has a rear end exposed at a rear side with respect to the metal shell, and has an axial hole extending along the axial direction; a center electrode that has a rear end located within the axial hole; a metal terminal that has a front end located within the axial hole and at the rear side with respect to the rear end of the center electrode and has a rear end exposed at the rear side with respect to the insulator; and a ground electrode that is joined to the metal shell, (b) a step of attaching the assembly to a pressure vessel such that a part, at a front side, of the assembly is located within the pressure vessel, (c) a step of attaching an insulating member including a tubular portion to the assembly so as to cover at least a part of a surface of a portion of the insulator that is exposed at the rear side with respect to the metal shell, (d) a step of pressurizing an interior of the pressure vessel and applying a predetermined voltage between the metal terminal and the metal shell, and (e) a step of detaching the assembly from the insulating member after the predetermined voltage is applied, and the method includes a lubricant adhering step of adhering a lubricant to at least one of a surface of the insulator to be covered by the insulating member attached in the step (c) and an inner surface of the insulating member for covering the surface of the insulator, before the step (c).

According to the above configuration, before the insulating member including the tubular portion is attached so as to cover at least a part of the surface of the portion of the insulator that is exposed at the rear side, the lubricant is adhered to the surface of the insulator to be covered by the insulating member. As a result, even when the insulating member is strongly brought into close contact with the insulator, the insulating member is easily detached from the assembly after the predetermined voltage is applied. Therefore, inspection of the insulator of the spark plug can smoothly be progressed while a flash over phenomenon along the portion of the insulator that is exposed at the rear side is inhibited during the inspection.

APPLICATION EXAMPLE 2

In accordance with a second aspect of the present invention, there is provided a method for producing the spark plug as described above, wherein the lubricant is powder of talc.

Even when a small amount of the powder of talc is adhered to the insulator, the powder of talc has almost no effect on the performance and the appearance of the spark plug. According to the above configuration, since the powder of talc is used as the lubricant, a step of removing the powder of talc can be omitted or simplified.

APPLICATION EXAMPLE 3

In accordance with a third aspect of the present invention, there is provided a method for producing the spark plug as described above, wherein the lubricant adhering step is a step of bringing an object having the lubricant adhered thereto into contact with at least one of the surface of the insulator and the inner surface of the insulating member for covering the surface of the insulator.

According to the above configuration, the lubricant can easily be adhered to the surface of the insulator.

APPLICATION EXAMPLE 4

In accordance with a fourth aspect of the present invention, there is provided a method for producing the spark plug as described above, wherein the object having the lubricant adhered thereto is a bag made of cloth and containing powder of the lubricant.

According to the above configuration, the powdery lubricant can easily be adhered to the surface of the insulator.

The technology disclosed in the present specification can be embodied in various forms. For example, the technology can be embodied in forms such as an inspection apparatus for a spark plug.

DETAILED DESCRIPTION OF THE PREFERRED EMBODIMENTS

A. Embodiment

A-1. Configuration of Spark Plug

Figure 1:
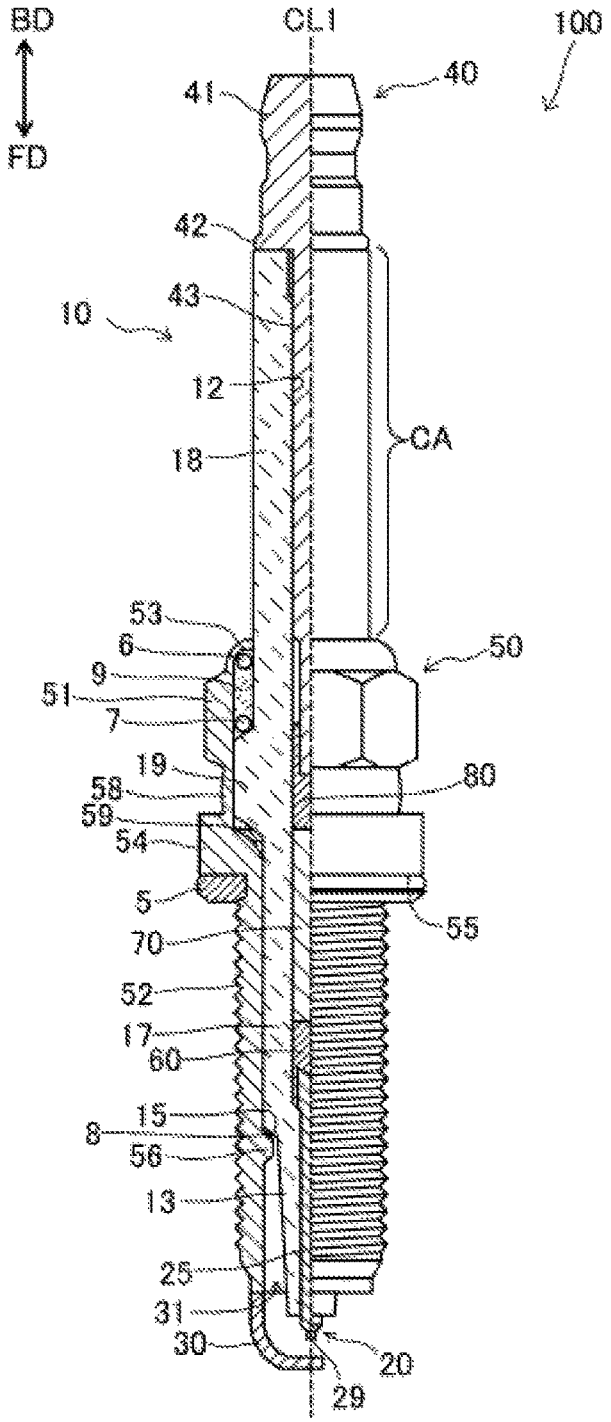
FIG. 1 is a cross-sectional view of a spark plug according to an embodiment, taken along a plane including an axial line.

Hereinafter, a mode of the present invention will be described on the basis of an embodiment. FIG. 1 is a cross-sectional view of a spark plug 100 according to the embodiment, taken along a plane including an axial line. In FIG. 1, an alternate long and short dashed line represents an axial line CL1 of the spark plug 100. A direction parallel to the axial line CL1 (the up-down direction in FIG. 1) is referred to as axial direction. The radial direction of a circle that has a center on the axial line CL1 and is present on a plane perpendicular to the axial line CL1 is referred to merely as "radial direction", and the circumferential direction of the circle is referred to merely as "circumferential direction". The downward direction in FIG. 1 is referred to as frontward direction FD, and the upward direction in FIG. 1 is referred to as rearward direction BD. The lower side in FIG. 1 is referred to as front side of the spark plug 100, and the upper side in FIG. 1 is referred to as rear side of the spark plug 100.

The spark plug 100 is mounted to an internal combustion engine and is used for igniting combustion gas within the combustion chamber of the internal combustion engine. The spark plug 100 includes an insulator 10, a center electrode 20, a ground electrode 30, a metal terminal 40, a metal shell 50, a resistor 70, and seal members 60 and 80.

The insulator 10 is formed by using, for example, a ceramic material containing $Al_2O_3$ (alumina) as a principal component. The insulator 10 is a substantially cylindrical member extending along the axial direction. The insulator 10 has an axial hole 12 that is a through hole extending along the axial direction and penetrating the insulator 10. The insulator 10 includes a flange portion 19, a rear trunk portion 18, a front trunk portion 17, a first reduced outer diameter portion 15, and a nose portion 13. The rear trunk portion 18 is located at the rear side with respect to the flange portion 19 and has a smaller outer diameter than the flange portion 19. The front trunk portion 17 is located at the front side with respect to the flange portion 19 and has a smaller outer diameter than the flange portion 19. The nose portion 13 is located at the front side with respect to the front trunk portion 17 and has a smaller outer diameter than the front trunk portion 17. When the spark plug 100 is mounted to an internal combustion engine (not shown), the nose portion 13 is exposed in the combustion chamber of the internal combustion engine. The first reduced outer diameter portion 15 is formed between the nose portion 13 and the front trunk portion 17. The first reduced outer diameter portion 15 has an outer diameter that is decreased toward the front side in the axial direction.

The metal shell 50 is formed from a conductive metal material (e.g., a low-carbon steel material) and is a cylindrical metal member for fixing the spark plug 100 to the engine head (not shown) of the internal combustion engine (FIG. 1). The metal shell 50 has a through hole 59 formed so as to extend along the axial line CL1 and penetrate the metal shell 50. The metal shell 50 is disposed at the outer periphery of the insulator 10. That is, the insulator 10 is inserted and held within the through hole 59 of the metal shell 50. The front end of the insulator 10 is exposed at the front side with respect to the front end of the metal shell 50. The rear end of the insulator 10 is exposed at the rear side with respect to the rear end of the metal shell 50.

The metal shell 50 includes: a tool engagement portion 51 that has a hexagonal columnar shape and with which a spark plug wrench is to be engaged; a mounting screw portion 52 for mounting the spark plug 100 to the internal combustion engine; and a flange-like seat portion 54 formed between the tool engagement portion 51 and the mounting screw portion 52. The nominal diameter of the mounting screw portion 52 is, for example, one of M8 (8 mm (millimeter)), M10, M12, M14, and M18.

An annular gasket 5 formed by a metal plate being bent is fitted between the mounting screw portion 52 and the seat portion 54 of the metal shell 50. When the spark plug 100 is mounted to the internal combustion engine, the gasket 5 seals the gap between the spark plug 100 and the internal combustion engine (engine head).

The metal shell 50 further includes: a thin crimp portion 53 provided to the rear side of the tool engagement portion 51; and a thin compressive deformation portion 58 provided between the seat portion 54 and the tool engagement portion 51. Annular ring members 6 and 7 are disposed in an annular region formed between the inner peripheral surface of the portion of the metal shell 50 that extends from the tool engagement portion 51 to the crimp portion 53, and the outer peripheral surface of the rear side trunk portion 18 of the insulator 10. The space between the two ring members 6 and 7 in the region is filled with powder of talc 9. The rear end of the crimp portion 53 is bent radially inward and fixed to the outer peripheral surface of the insulator 10. The compressive deformation portion 58 of the metal shell 50 compressively deforms by the crimp portion 53, which is fixed to the outer peripheral surface of the insulator 10, being pressed toward the front side during manufacturing. The insulator 10 is pressed within the metal shell 50 toward the front side via the ring members 6 and 7 and the talc 9 due to the compressive deformation of the compressive deformation portion 58. The first reduced outer diameter portion 15 of the insulator 10 is pressed by a ledge portion 56 formed on the inner periphery of the mounting screw portion 52 of the metal shell 50, via an annular plate packing 8 made of metal. As a result, the plate packing 8 prevents gas within the combustion chamber of the internal combustion engine from leaking to the outside through the gap between the metal shell 50 and the insulator 10.

The metal terminal 40 is a bar-shaped member extending in the axial direction and is disposed at the rear side of the axial hole 12 of the insulator 10. The metal terminal 40 is formed from a conductive metal material (e.g., low-carbon steel), and a metal layer (e.g., an Ni layer) for anticorrosion is formed on the surface of the metal terminal 40 by plating or the like. The metal terminal 40 includes: a flange portion 42 (terminal jaw portion) formed at a predetermined position in the axial direction; a cap mounting portion 41 located at the rear side with respect to the flange portion 42; and a nose portion 43 (terminal nose portion) located at the front side with respect to the flange portion 42. The cap mounting portion 41 of the metal terminal 40 is exposed at the rear side with respect to the insulator 10. The nose portion 43 of the metal terminal 40 is inserted in the axial hole 12 of the insulator 10. That is, the front end of the metal terminal 40 is located at the rear side in the axial hole 12 with respect to the rear end of the center electrode 20, and the rear end of the metal terminal 40 is exposed at the rear side with respect to the insulator 10. A plug cap to which a high-voltage cable (not shown) is connected is mounted to the cap mounting portion 41, and a high voltage for causing spark discharge to occur is applied to the cap mounting portion 41.

The center electrode 20 is a substantially bar-shaped member extending in the axial direction. The center electrode 20 is disposed at the front side of the axial hole 12 of the insulator 10. The rear end of the center electrode 20 is located within the axial hole 12, and the front end of the center electrode 20 is exposed at the front side with respect to the insulator 10. The center electrode 20 includes: a substantially bar-shaped center electrode body 25; and a columnar center electrode tip 29 joined to the front end of the center electrode body 25 (FIG. 1).

The ground electrode 30 is a bent bar-shaped body having a quadrangular cross-section. A rear end portion of the ground electrode 30 is joined to the front end surface of the metal shell 50 by means of welding. Accordingly, the metal shell 50 and the ground electrode 30 are electrically connected to each other. The front end of the ground electrode 30 is a free end. The gap between the center electrode tip 29 and the vicinity of the free end of the ground electrode 30 is a so-called spark gap in which spark discharge occurs. The ground electrode 30 may include a ground electrode tip that is the same as the center electrode tip 29, at a portion that defines the spark gap.

The ground electrode 30 and the center electrode body 25 are each formed by using, for example, nickel or an alloy containing nickel as a principal component (e.g., NCF 600, NCF 601). The ground electrode 30 and the center electrode body 25 may each have a two-layer structure including: a base material formed from a metal (e.g., a nickel alloy) having high corrosion resistance; and a core portion that is formed by using a metal (e.g., copper) having high thermal conductivity and that is buried in the base material. The center electrode tip 29 is formed by using, for example, a noble metal such as Pt (platinum) or Ir (iridium), or an alloy containing a noble metal as a principal component.

The resistor 70 is disposed in the axial hole 12 of the insulator 10 and between the front end of the metal terminal 40 (the front end of the nose portion 43) and the rear end of the center electrode 20 (the rear end of the center electrode body 25). That is, the resistor 70 is disposed at the rear side in the axial direction with respect to the center electrode 20 in the axial hole 12. The resistor 70 has a resistance of not less than 1 KΩ (e.g., 5 KΩ), for example, and has a function to reduce electric wave noise at the time of occurrence of spark. The resistor 70 is formed from, for example, a composition containing glass particles as a principal component, ceramic particles other than glass, and a conductive material.

The seal member 60 is disposed between the resistor 70 and the center electrode 20 (the center electrode body 25) in the axial hole 12 and fills the gap between the resistor 70 and the center electrode 20. The seal member 80 is disposed between the resistor 70 and the metal terminal 40 (the nose portion 43) in the axial hole 12 and fills the gap between the resistor 70 and the metal terminal 40. The seal members 60 and 80 are each formed from a conductive material, that is, for example, a composition containing glass particles of a $B_2O_3$—$SiO_2$-based material or the like and metal particles (Cu, Fe, etc.). The resistance of each of the seal members 60 and 80 is less than 1 KΩ, for example, several hundred mmΩ.

A-2. Method for Producing Spark Plug 100

Next, a method for producing the above-described spark plug 100 will be described. The method for producing the spark plug 100 includes inspection of the dielectric strength of the insulator 10 of the spark plug 100. Hereinafter, the inspection of the dielectric strength of the insulator 10 will be mainly described.

A-2-1. Entire Configuration of Inspection Apparatus for Spark Plug 100

Figure 2:
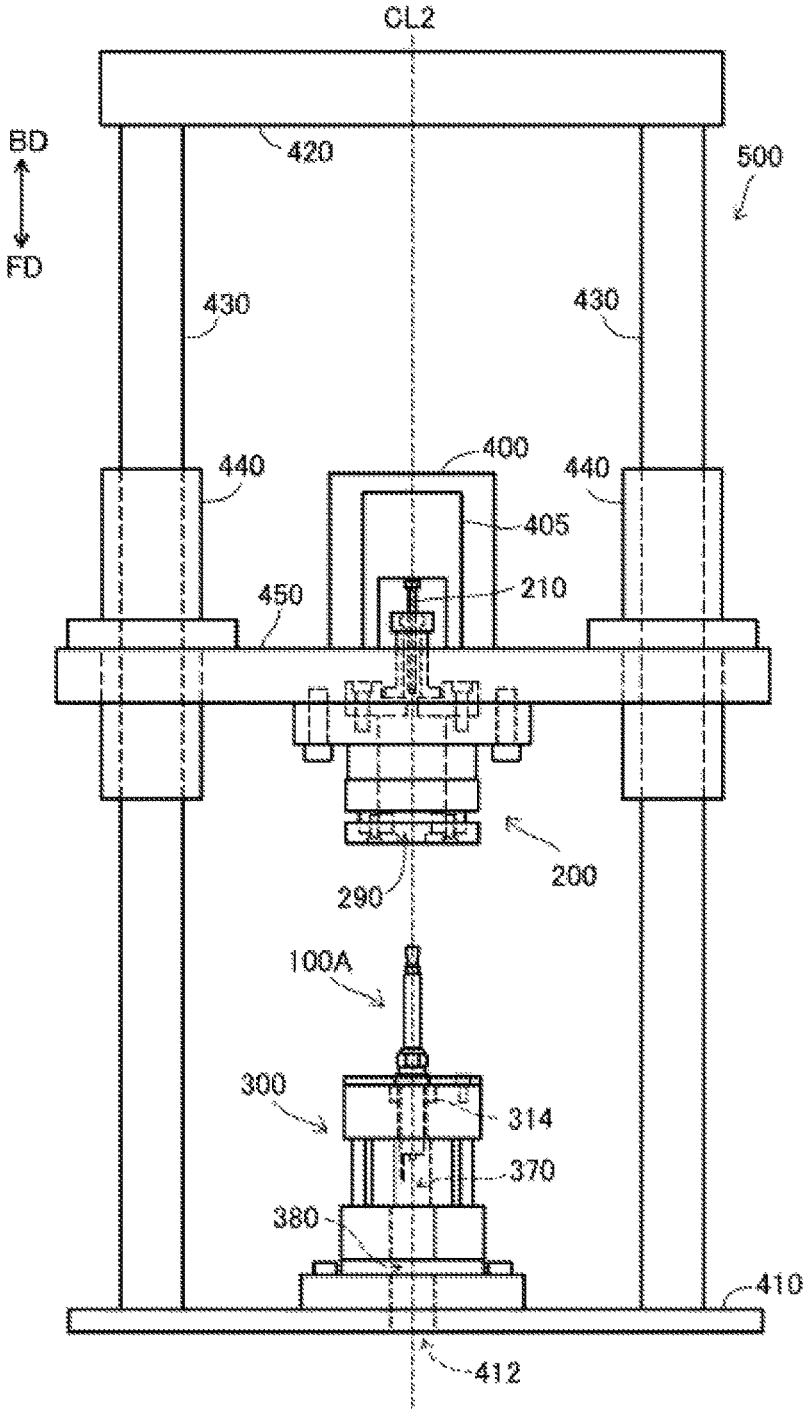
FIG. 2 is a diagram showing the entire configuration of an inspection apparatus for the spark plug according to the embodiment.

FIG. 2 is a diagram showing the entire configuration of an inspection apparatus 500 for the spark plug 100 according to the present embodiment. As shown in FIG. 2, an assembly 100A that is an intermediate product in a production process for the spark plug 100 is attached to the inspection apparatus 500 at the time of inspection of dielectric strength. The assembly 100A is different from the spark plug 100 only in that the ground electrode 30 is not bent and the gasket 5 is not assembled in the assembly 100A. Thus, the axial line of the assembly 100A is the same as the axial line CL1 of the spark plug 100. Here, a straight line that coincides with the axial line CL1 of the assembly 100A when the assembly 100A is attached to the inspection apparatus 500 is referred to as axial line CL2 of the inspection apparatus 500. Similarly to FIG. 1, in FIG. 2, the radial direction of a circle that has a center on the axial line CL2 and is present on a plane perpendicular to the axial line CL2 is referred to merely as "radial direction", and the circumferential direction of the circle is referred to merely as "circumferential direction". The downward direction in FIG. 2 (i.e., the vertically downward direction of the inspection apparatus 500) is referred to as frontward direction FD, and the upward direction in FIG. 2 (i.e., the vertically upward direction of the inspection apparatus 500) is referred to as rearward direction BD. The lower side in FIG. 2 (i.e., the vertically lower side of the inspection apparatus 500) is referred to as front side of the inspection apparatus 500, and the upper side in FIG. 2 (i.e., the vertically upper side of the inspection apparatus 500) is referred to as rear side of the inspection apparatus 500.

The inspection apparatus 500 includes a pressing/energizing unit 200, a pressure vessel 300, a voltage application unit 400, a lower fixing plate 410, an upper fixing plate 420, a pair of pillars 430, a pair of slide support portions 440, and a movable shelf 450.

The pressing/energizing unit 200 seals an opening of a seal portion 314 (described later) of the pressure vessel 300 with the assembly 100A attached to the pressure vessel 300 by pressing the assembly 100A, in the frontward direction PD. In addition, the pressing/energizing unit 200 applies a current to the assembly 100A in performing the inspection of the dielectric strength of the insulator 10. The pressing/energizing unit 200 is fixed to the front side surface of the movable shelf 450. The pressing/energizing unit 200 has an insertion hole 290 formed at the position of intersection with the axial line CL1 so as to extend in the axial direction. In performing the inspection of the dielectric strength of the insulator 10, a part, at the rear side, of the assembly 100A is inserted into the insertion hole 290. The pressing/energizing unit 200 includes a conductive pin 210 at the rear side. The conductive pin 210 is disposed so as to be movable within the insertion hole 290 along the axial direction. The detailed configuration of the pressing/energizing unit 200 will be described later.

The pressure vessel 300 has a substantially cylindrical shape having a center axis along the axial direction, and is fixed to the rear side surface of the lower fixing plate 410. A space having a bottomed substantially cylindrical shape (hereinafter, referred to as "chamber 370") is formed within the pressure vessel 300. The seal portion 314 having the opening formed at the center thereof is disposed at an end portion at the rear side (an upper end portion in FIG. 2) of the chamber 370, and the interior of the chamber 370 is made airtight by the opening of the seal portion 314 being closed by the assembly 100A. The chamber 370 is connected to an air tank and a pressure regulating valve that are not shown, and the internal pressure of the chamber 370 is regulated by the pressure regulating valve. The internal pressure of the chamber 370 is increased to a predetermined pressure (5 MPa in the present embodiment). Instead of 5 MPa, any pressure in the range of 0 MPa to 5 MPa may be adopted as the predetermined pressure. A bottom portion 380 of the chamber 370 is formed from a transparent material, such as an acrylic resin or glass, such that the interior of the chamber 370 is viewable. Thus, as described later, an image of the front end of the assembly 100A located within the chamber 370 can be captured from the rear side of the pressure vessel 300. Therefore, presence/absence of a defect in the insulator 10 can easily be confirmed on the basis of the captured image. The detailed configuration of the pressure vessel 300 will be described later.

In performing a test for dielectric strength, the voltage application unit 400 applies a predetermined voltage (e.g., 30 to 45 kV in the present embodiment) to the assembly 100A. The voltage application unit 400 includes a conductive pin drive portion 405. The conductive pin drive portion 405 moves the conductive pin 210 along the axial direction by pressing or pulling the conductive pin 210 along the axial direction, although the detailed structure of the conductive pin drive portion 405 is not shown. In addition, the conductive pin drive portion 405 applies a voltage such that the potential of the conductive pin 210 becomes a predetermined potential.

The tower fixing plate 410 is a plate-like member disposed perpendicularly to the axial line CL2. The lower fixing plate 410 has a through hole 412 formed at the position of intersection with the axial line CL2 so as to penetrate the fixing plate 410 in the thickness direction thereof (the axial direction). The through hole 412 is formed at a position corresponding to the bottom portion 380 of the pressure vessel 300. Thus, the interior of the chamber 370 can be viewed through the through hole 412 and the bottom portion 380 by viewing the front side of the lower fixing plate 410 toward the frontward direction FD. It should be noted that an imaging device that is not shown is disposed in the through hole 412, and an image of a front end portion of the assembly 100A disposed within the chamber 370 is captured by the imaging device.

The upper fixing plate 420 is a plate-like member disposed perpendicularly to the axial line CL2, and is disposed at the rear side with respect the lower fixing plate 410 so as to be spaced from the lower fixing plate 410 by a predetermined distance. The pair of pillars 430 are each a columnar member provided so as to extend along the axial direction, and are each connected at one end thereof to the lower fixing plate 410 and at another end thereof to the upper fixing plate 420. The pair of slide support portions 440 each have a substantially cylindrical shape. The pair of slide support portions 440 are attached to the different pillars 430, respectively, so as to be movable in the axial direction, and are moved along the axial direction by a drive portion that is not shown.

The movable shelf 450 is a plate-like member disposed perpendicularly to the axial line CL2, and both ends of the movable shelf 450 are connected to the pair of slide support portions 440, respectively. When the slide support portions 440 move in the axial direction, the movable shelf 450 moves (up or down) in the axial direction while maintaining a state of being perpendicular to the axial line CL2. The pressing/energizing unit 200 is installed on the front side surface of the movable shelf 450, and the voltage application unit 400 is installed on the rear side surface of the movable shelf 450. The movable shelf 450 has a through hole formed at the position of intersection with the axial line CL2 so as to penetrate the movable shelf 450 in the thickness direction thereof (the axial direction), and a part of the pressing/energizing unit 200 is disposed in the through hole. In the present embodiment, each of the lower fixing plate 410, the upper fixing plate 420, the pair of pillars 430, the pair of slide support portions 440, and the movable shelf 450 is formed from a steel material.

A-2-2. Detailed Configuration of Pressing/Energizing Unit 200

Figure 3:
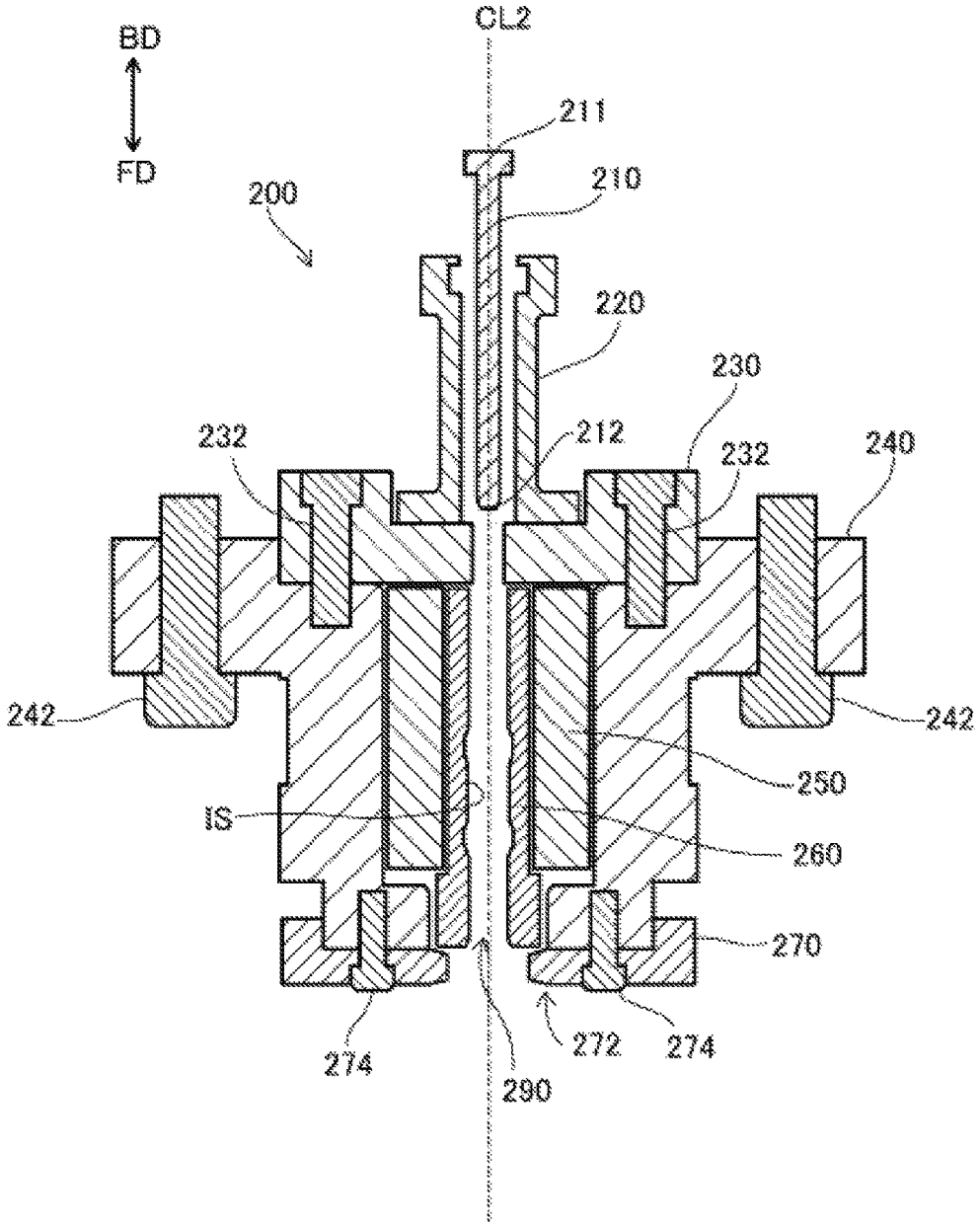
FIG. 3 is a cross-sectional view of a pressing/energizing unit, taken along a plane including an axial line.

FIG. 3 is a cross-sectional view of the pressing/energizing unit 200 shown in FIG. 2, taken along a plane including the axial line CL2. The pressing/energizing unit 200 includes, in addition to the above-described conductive pin 210, a guide portion 220, a first support portion 230, first fixing screws 232, a second support portion 240, second fixing screws 242, a cap holder 250, a cap 260, and an electrode member 270.

The conductive pin 210 has a bar shape and is formed from a material having electrical conductivity, for example, a steel material (e.g., a stainless steel material, S45C-H, etc.). The conductive pin 210 has a flange portion 211 located at an end portion at the rear side and having a larger diameter than the other portion thereof, and a front end portion 212. The flange portion 211 is connected to the above-described conductive pin drive portion 405 and receives drive force from the conductive pin drive portion 405. In later-described inspection of dielectric strength, the front end portion 212 is brought into contact with the metal terminal 40 of the assembly 100A to apply a voltage to the assembly 100A.

The guide portion 220 has a substantially cylindrical shape having an axial hole formed at the position of intersection with the axial line CL2. The conductive pin 210 is housed in the axial hole of the guide portion 220. The guide portion 220 is formed from, for example, a rubber having an electrical insulation property such as silicone rubber, acrylic rubber, or butyl rubber.

The first support portion 230 has a disk shape and supports the guide portion 220. The first support portion 230 has a through hole formed at the position of intersection with the axial line CL2 so as to penetrate the first support portion 230 in the thickness direction thereof (the axial direction). The through hole of the first support portion 230 communicates with the axial hole of the guide portion 220. The first support portion 230 is fixed to the second support portion 240 by means of the first fixing screws 232 that are formed from a resin.

The second support portion 240 has a substantially cylindrical shape having a flange portion at the rear side. The second support portion 240 has an axial hole formed at the position of intersection with the axial line CL2 so as to penetrate the second support portion 240 in the axial direction. The second support portion 240 is adjacent to the first support portion 230 at the front side and supports the first support portion 230. The second support portion 240 is fixed to the front side surface of the movable shelf 450 by means of the second fixing screws 242 that are formed from a metal. The first support portion 230 and the second support portion 240 are formed from a material having an electrical insulation property; and are formed from a resin material such as a polyacetal resin or a polyether ether ketone resin in the present embodiment.

The electrode member 270 is fixed to the front end surface of the second support portion 240 by means of electrode fixing screws 274 that are formed from a metal. The electrode member 270 is formed from a material having electrical conductivity, and is brought into contact with the metal shell 50 of the assembly 100A to earth the metal shell 50 in inspection of dielectric strength. The electrode member 270 has a disk shape having a through hole formed in a portion interesting the axial line CL2 so as to extend in the thickness direction thereof (the axial direction), and is formed from, for example, a low-carbon steel material. An edge 272 of the inner peripheral surface forming the through hole of the electrode member 270 is chamfered.

The cap holder 250 is housed and held within the axial hole of the second support portion 240. The cap holder 250 has a substantially cylindrical shape, and is formed from a material having an electrical insulation property. In the present embodiment, the cap holder 250 is formed from polyacetal. The cap holder 250 inhibits the cap 260 from deforming radially outward when the cap 260 is attached to the rear side of the assembly 100A. Accordingly, when the cap 260 is attached to the rear side of the assembly 100A, adhesiveness between the cap 260 and the surface of the insulator 10 or the metal terminal 40 of the assembly 100A improves.

The cap 260 is housed and held within an axial hole of the cap holder 250 that is formed at the position of intersection with the axial line CL2. The cap 260 is an insulating member having a substantially cylindrical shape. The cap 260 is formed from a rubber or elastomer having elasticity and having an electrical insulation property, specifically, silicone rubber, acrylic rubber, or butyl rubber. The diameter of an axial hole of the cap 260 is slightly smaller than the outer diameter of the insulator 10 (the outer diameter of the rear trunk portion 18) that is inserted into this axial hole at the time of inspection of dielectric strength. Therefore, when the cap 260 is attached to the insulator 10, the inner peripheral surface of the cap 260 is in close contact with the surface of the insulator 10 at a predetermined pressure.

As described above, the portion of the pressing/energizing unit 200 other than the conductive pin 210, the second fixing screws 242, the electrode member 270, and the electrode fixing screws 274 is formed from rubber or resin having an electrical insulation property. The reason for this is for inhibiting a flash over phenomenon, in which a current flows between the metal terminal 40 and the metal shell 50 via the pressing/energizing unit 200, from occurring in inspection of the dielectric strength of the insulator 10.

As shown in FIG. 3, the conductive pin 210, the guide portion 220, the first support portion 230, the second support portion 240, the cap holder 250, the cap 260, and the electrode member 270 have the shared axial line CL2. The axial hole of the guide portion 220, the through hole of the first support portion 230, the axial hole of the cap 260, and the through hole of the electrode member 270 communicate with each other to form the insertion hole 290.

A-2-3. Detailed Configuration of Pressure Vessel 300

Figure 4:
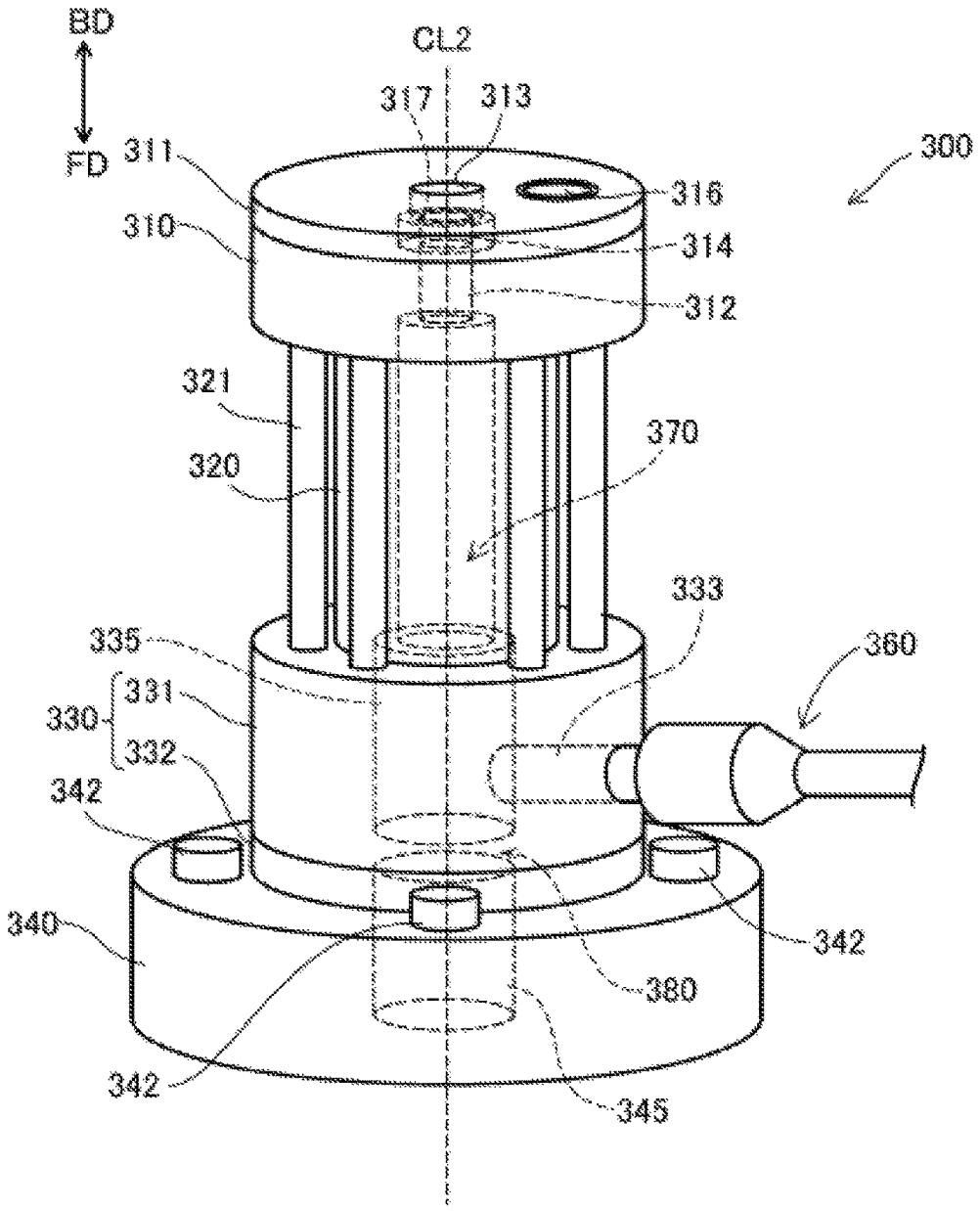
FIG. 4 is a perspective view of a pressure vessel.

FIG. 4 is a perspective view of the pressure vessel 300 shown in FIG. 2. The pressure vessel 300 includes an upper support portion 310, the seal portion 314, a seal portion holder 311, a front end housing portion 320, a plurality of pillars 321, a central support portion 330, and a lower support portion 340. The upper support portion 310, the seal portion 314, the seal portion holder 311, the front end housing portion 320, the central support portion 330, and the lower support portion 340 are cylindrical or columnar members having the shared axial line CL2.

The upper support portion 310 is located at the rearmost side in the pressure vessel 300 and has a substantially columnar shape. The upper support portion 310 has a housing hole 312 formed at the position of intersection with the axial line CL2. The housing hole 312 is a through hole that penetrates the upper support portion 310 in the thickness direction thereof (the axial direction). In inspection of dielectric strength, the housing hole 312 receives a part, at the front side, of the assembly 100A, more specifically, a portion corresponding to a part, at the rear side, of the mounting screw portion 52. The diameter of the housing hole 312 is larger than the diameter of a thread ridge of the mounting screw portion 52.

The upper support portion 310 has a hole formed at the rear end of the housing hole 312 and having a larger diameter than the housing hole 312, and the seal portion 314 is housed in this hole. The seal portion 314 has a ring shape having an axial hole formed therein, and is housed in the above hole provided in the upper support portion 310, such that the central axis of the seal portion 314 coincides with the axis of the housing hole 312. The axial hole of the seal portion 314 has a diameter substantially equal to the diameter of the housing hole 312 and communicates with the housing hole 312. Similarly to the housing hole 312, the axial hole of the seal portion 314 receives the part, at the front side, of the assembly 100A in inspection of dielectric strength. Hereinafter, a hole obtained by combining the axial hole of the seal portion 314 and the housing hole 312 is sometimes referred to as housing hole 312. In inspection of dielectric strength, the seal portion 314 seals an opening of the chamber 370 by being brought into contact with a front end surface 55 (FIG. 1) of the seat portion 54 of the assembly 100A. The above-described "opening of the chamber 370" is an opening to be sealed by the assembly 100A, and means an opening 317 at the upper end of the axial hole of the seal portion 314 in the present embodiment. The seal portion 314 is formed from, for example, a rubber or a resin such as urethane.

The seal portion holder 311 has a substantially columnar shape thinner than that of the upper support portion 310. The outer diameter of the seal portion holder 311 is substantially equal to the outer diameter of the upper support portion 310. The seal portion holder 311 is disposed in contact with the rear side surface of the upper support portion 310 such that the central axis of the seal portion holder 311 coincides with the central axis of the upper support portion 310, and is fixed to the upper support portion 310 by means of a fixing screw 316. The seal portion holder 311 has a through hole 313 formed at the position of intersection with the axial line CL2 so as to extend in the thickness direction thereof. The diameter of the through hole 313 is larger than that of each of the housing hole 312 and the axial hole of the seal portion 314 and smaller than the outer diameter of the seal portion 314. The through hole 313 communicates with the housing hole 312. In inspection of dielectric strength, the through hole 313 receives a part of the assembly 100A, more specifically, a part of the seat portion 54. The seal portion holder 311 holds the seal portion 314 from the rear side and restricts movement of the seal portion 314 in the axial direction.

The front end housing portion 320 has a cylindrical shape and is adjacent to the upper support portion 310 at the front side. The front end housing portion 320 is formed from, for example, a transparent resin material such as an acrylic resin. The internal space of the front end housing portion 320 communicates with the housing hole 312. In later-described inspection of dielectric strength, the front end housing portion 320 receives a front end portion of the assembly 100A, more specifically, a portion corresponding to a part, at the front side, of the mounting screw portion 52 and a portion located at the front side with respect to this portion (the center electrode 20, a part of the nose portion 13, and the ground electrode 30). The outer diameter of the front end housing portion 320 is smaller than that of the upper support portion 310.

The plurality of pillars 321 are disposed at the radially outer side of the front end housing portion 320 and aligned at predetermined intervals in the circumferential direction. The pillars 321 are each a thin columnar member and connected at one end thereof to the front side surface of the upper support portion 310 and at another end thereof to the rear side surface of the central support portion 330.

The central support portion 330 has a substantially columnar shape and is disposed adjacently at the front side with respect to the front end housing portion 320. The outer diameter of the central support portion 330 is substantially equal to that of the upper support portion 310. The central support portion 330 is disposed in contact with the front end housing portion 320 and connected to a pipe 360. The central support portion 330 includes a main support portion 331 and a viewable portion 332.

The main support portion 331 has a center hole 335 formed at the position of intersection with the axial line CL2 so as to penetrate the main support portion 331 in the axial direction. The main support portion 331 has a communication hole 333 formed so as to provide communication between a connection portion of the pipe 360 and the center hole 335. The viewable portion 332 is a disk-shaped member disposed in contact with the front side surface of the main support portion 331. The front side surface of the viewable portion 332 and the rear side surface of the main support portion 331 are joined to each other. The viewable portion 332 is formed from a transparent material such as an acrylic resin or glass.

The housing hole 312, the internal space of the front end housing portion 320, and the center hole 335 communicate with each other in the axial direction to form the above-described chamber 370 within the pressure vessel 300. The viewable portion 332 covers the front side of the above-described center hole 335 and forms the bottom portion 380 of the chamber 370. The pressure regulating valve that is not shown is connected to the pipe 360, and the internal pressure of the chamber 370 is increased by compressed air being supplied via the pipe 360 into the chamber 370. In inspection of dielectric strength, only a part, at the front side, of the assembly 100A is housed in the chamber 370. Thus, the size of the pressure vessel 300 is smaller than that of a vessel having a chamber for housing the entirety of the assembly 100A.

The lower support portion 340 has a substantially columnar shape and is disposed adjacently at the front side with respect to the central support portion 330. The lower support portion 340 has an observation hole 345 formed at the position of intersection with the axial line CL2 so as to penetrate the lower support portion 340 in the axial direction. The interior of the chamber 370 can be observed through the observation hole 345 and the viewable portion 332 (the bottom portion 380) from the front side of the lower support portion 340. The rear side surface of the lower support portion 340 is joined to the front side surface of the central support portion 330 (the front side surface of the viewable portion 332). The outer diameter of the lower support portion 340 is larger than that of the central support portion 330. The lower support portion 340 is fixed to the lower fixing plate 410 by means of a plurality of fixing screws 342.

A-2-4. Steps of Method for Producing Spark Plug 100

Figure 5:
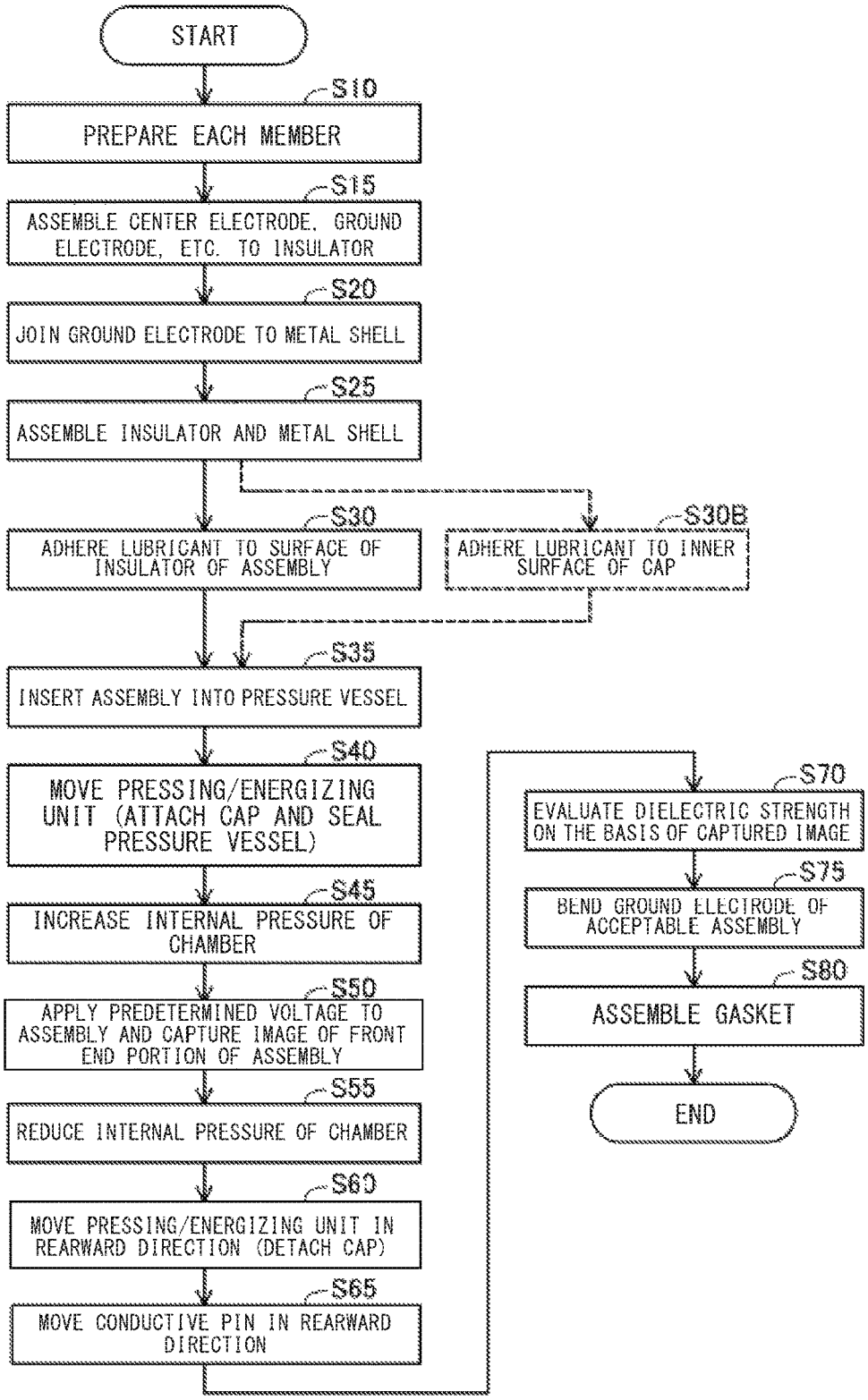
FIG. 5 is a flowchart showing steps of a method for producing the spark plug.

FIG. 5 is a flowchart showing steps of the method for producing the spark plug 100. In S10 to S25, the above-described assembly 100A is prepared. First, in S10, each member forming the spark plug 100 is prepared. In S15, the center electrode 20 and the metal terminal 40 are inserted into the axial hole 12 of the insulator 10 and assembled to the insulator 10. At this time, in the axial hole 12, the seal members 60 and 80 and the resistor 70 in FIG. 1 are enclosed between the axial hole 12 and the metal terminal 40. In S20, the ground electrode 30 is joined to the front end surface of the metal shell 50, for example, by means of resistance welding. In S25, the metal shell 50 and the insulator 10 to which the center electrode 20, the metal terminal 40, etc. have been assembled in S15, are assembled to obtain the assembly 100A.

Figure 6A:
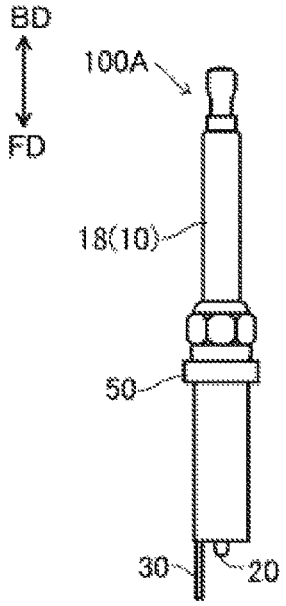
FIGS. 6(A) and 6(B) are explanatory diagrams of the method for producing the spark plug.
Figure 6B:
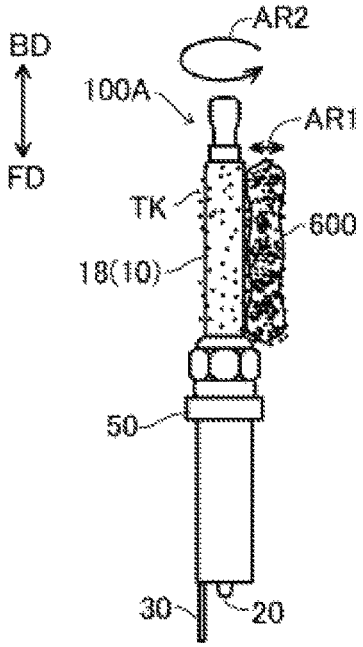

FIGS. 6(A) and 6(B) are explanatory diagrams of the method for producing the spark plug 100. FIG. 6(A) shows the assembly 100A. As described above, the assembly 100A is different from the spark plug 100 only in that the ground electrode 30 is not bent and the gasket 5 is not assembled in the assembly 100A.

In S30, a lubricant is adhered to the surface of the insulator 10, specifically; the surface of the rear trunk portion 18 exposed at the rear side with respect to the metal shell 50, of the insulator 10. In the present embodiment, powder of talc is used as the lubricant. If the particle size of powder TK of talc is excessively large, when the cap 260 is attached to the insulator 10 in S40 described later, adhesiveness between the insulator 10 and the cap 260 can be decreased. Thus, the particle size of the powder TK of talc is, for example, preferably not greater than 850 μm. In the present embodiment, the particle size of the powder TK of talc is adjusted to 5 μm to 850 μm. An axial range CA where the lubricant is adhered is a portion to be covered by the cap 260 attached in S40 described later, and is the entirety of the portion of the rear trunk portion 18 that is exposed from the metal shell 50, as shown in FIG. 1.

FIG. 6(B) illustrates a lubricant adhering step of adhering the lubricant. In the lubricant adhering step of the present embodiment, the lubricant is adhered to the surface of the insulator 10 by bringing an object having the lubricant adhered thereto into contact with the surface of the insulator 10. Specifically, as shown in FIG. 6(B), a bag 600 made of cloth in which the powder TK of talc is contained is prepared. The gaps (apertures) between fibers of the bag 600 are made larger than the particle size of the powder TK of talc. Thus, for example, when impact is applied to the bag 600, part of the powder TK of talc is released through the gaps between the fibers to the outside and adheres and remains on the surface of the bag 600 and in the vicinity thereof. By bringing the bag 600 in this state into contact with the surface of the insulator 10, the powder TK of talc can be adhered to the surface of the insulator 10. For example, the assembly 100A is attached to a holding tool that is not shown, and is rotated about the axial line by power of a motor as shown by an arrow AR2. The bag 600 held by another holding tool that is not shown is reciprocated in the radial direction of the assembly 100A multiple times as shown by an arrow AR1. Accordingly, the bag 600 collides and contacts with the rear trunk portion 18 of the rotating assembly 100A multiple times. As a result, the powder TK of talc adheres to the entire periphery of the above-described axial range CA of the rear trunk portion 18 of the assembly 100A.

In S35, the front side of the assembly 100A is inserted into the pressure vessel 300 through the upper end of the through hole 313 of the seal portion holder 311. Accordingly, the assembly 100A is attached to the pressure vessel 300 such that a part, at the front side, of the assembly 100A (specifically, the portion of the metal shell 50 at the front side with respect to the seat portion 54) is located within the pressure vessel 300 (i.e., within the chamber 370), A state of the inspection apparatus 500 and the assembly 100A immediately after S35 is executed is a state shown in FIG. 2. That is, the assembly 100A is attached to the pressure vessel 300, and the pressing/energizing unit 200 is disposed at the rear side of the assembly 100A. As a result of execution of S35, the opening of the chamber 370, that is, the opening 317 of the seal portion 314, is closed by the seat portion 54 of the assembly 100A. However, at this time, airtightness of the interior of the chamber 370 is not ensured.

In S40, the pressing/energizing unit 200 is moved in the frontward direction FD (lowered). Accordingly, the cap 260 is attached to the assembly 100A. In addition, force in the frontward direction FD is applied to the assembly 100A by the conductive pin 210 and the electrode member 270. Thus, the front end surface 55 of the seat portion 54 of the assembly 100A is pressed against the upper end surface of the seal portion 314, and the opening 317 of the pressure vessel 300 is sealed by the assembly 100A.

Figure 7:
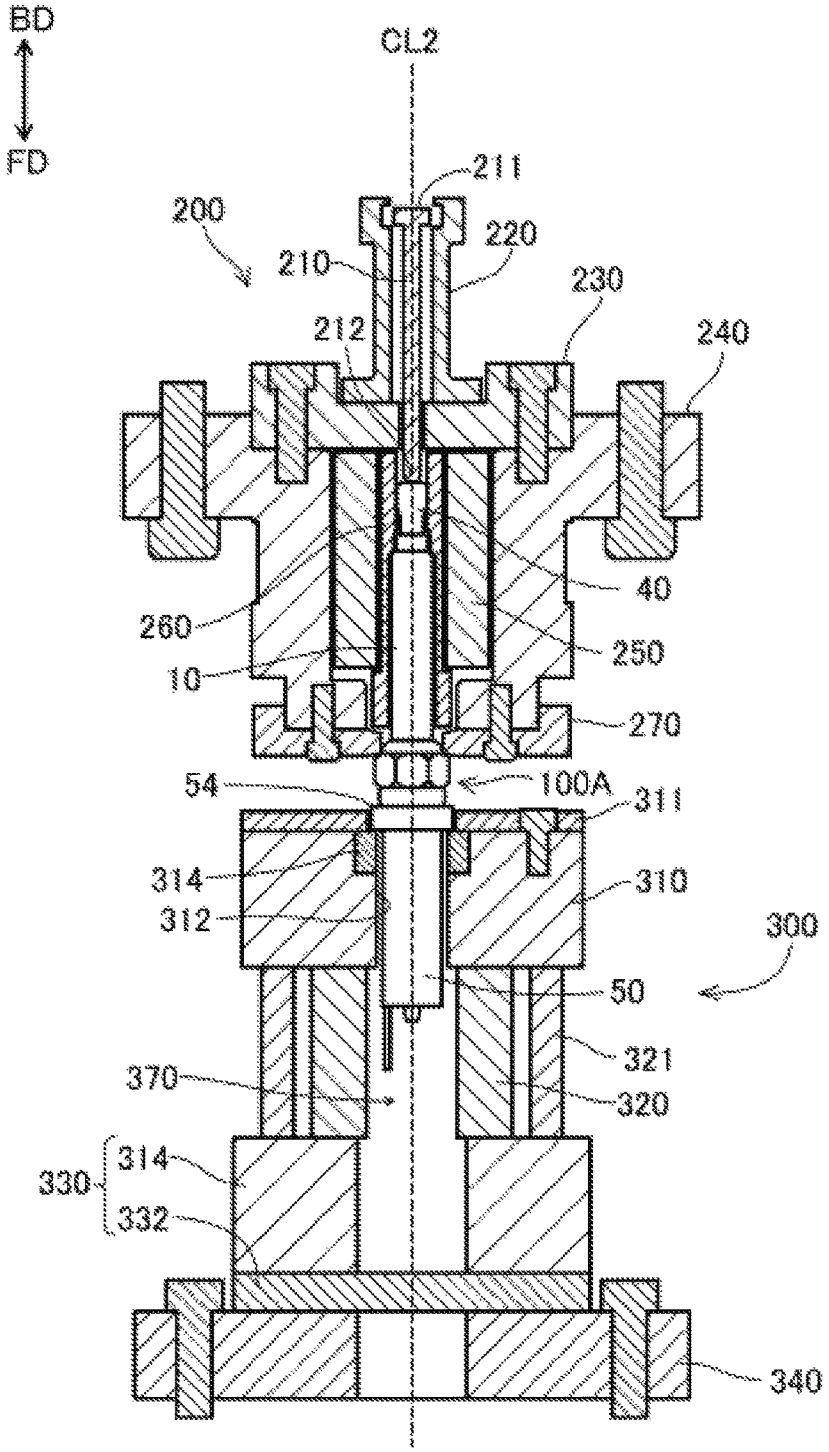
FIG. 7 is an explanatory diagram showing the inspection apparatus and an assembly in a state where S40 is executed.

FIG. 7 is an explanatory diagram showing the inspection apparatus 500 and the assembly 100A in a state where S40 is executed. In FIG. 7, for convenience of explanation, of the inspection apparatus 500, only the pressing/energizing unit 200 and the pressure vessel 300 are illustrated. As shown in FIG. 7, S40 is executed in a state where the axial line CL2 of the inspection apparatus 500 coincides with the axial line CL1 of the assembly 100A.

When the pressing/energizing unit 200 moves in the frontward direction FD from the state shown in FIG. 1, the rear side of the assembly 100A is inserted into the insertion hole 290 of the pressing/energizing unit 200. When the movement further proceeds, the rear trunk portion 18 of the insulator 10 is inserted into the axial hole of the cap 260. Accordingly, the cap 260 is attached to the assembly 100A so as to cover the surface of the portion of the assembly 100A that is exposed at the rear side with respect to the metal shell 50. The inner diameter of the axial hole of the cap 260 is smaller than the outer diameter of the rear trunk portion 18. However, since the cap 260 is formed from an elastic material (e.g., rubber), the axial hole of the cap 260 is enlarged in diameter, and the rear trunk portion 18 is inserted thereinto. Then, the enlargement of the outer diameter of the cap 260 is limited by the cap holder 250. Thus, in a state shown in FIG. 7, the inner peripheral surface forming the axial hole of the cap 260 is in contact with the outer peripheral surface of the rear trunk portion 18 at a relatively high pressure. As a result, adhesiveness between the cap 260 and the rear trunk portion 18 improves. Similarly, the cap 260 is also in close contact with the cap mounting portion 41 of the metal terminal 40. As shown FIG. 7, the axial length of the cap 260 is longer than the sum of: the axial length of the entirety of the portion of the insulator 10 that is exposed at the rear end; and the axial length of the cap mounting portion 41 of the metal terminal 40. The cap 260 is in close contact with substantially the entirety of the outer peripheral surface of the portion of the insulator 10 that is exposed at the rear end and substantially the entirety of the outer peripheral surface of the cap mounting portion 41.

As shown in FIG. 7, the pressing/energizing unit 200 moves to a position at which the edge 272 of the electrode member 270 comes into contact with the rear side of the tool engagement portion 51 of the assembly 100A. Then, even after the electrode member 270 comes into contact with the tool engagement portion 51, the pressing/energizing unit 200 continuously presses the assembly 100A in the frontward direction FD via the electrode member 270 until the pressing/energizing unit 200 is moved in the rearward direction BD in S60 described later. The pressing force at this time is force with which the interior of the chamber 370 can withstand pressure increase to a predetermined pressure (e.g., 5 MPa), and is, for example, a force of 300 kgf.

As described above, the opening 317 of the chamber 370 is sealed by the assembly 100A pressing the pressure vessel 300 (the seal portion 314), and thus airtightness of the pressure vessel 300 can easily be ensured.

Pressing the assembly 100A by the pressing/energizing unit 200 and attaching the cap 260 to the insulator 10 are performed in a state where the axial line CL2 of the opening 317 of the chamber 370 coincides with the axial line CL1 of the assembly 100A. Accordingly, the opening 317 is inhibited from being closed by the assembly 100A in a displaced manner, and thus the airtightness of the pressure vessel 300 can be improved. Moreover, the cap 260 can be inhibited from being attached to the insulator 10 in a displaced manner, and thus occurrence of a flash over phenomenon in which a current flows along the surface of the portion of the insulator 10 that is exposed at the rear side, can be inhibited.

A pressurizing axis along which the assembly 100A is pressed (the axial line CL1) coincides with the central axis (the axial line CL2) of the opening 317 to be sealed. Thus, as compared to the configuration in which the pressurizing axis and the central axis of the opening 317 are displaced with respect to each other, the rigidity of the pressing/energizing unit 200 can be decreased in the case of ensuring the same level of airtightness. Therefore, many of the components of the pressing/energizing unit 200 can be formed from rubber or resin material having an electrical insulation property. As a result, occurrence of the above-described flash over phenomenon can be more effectively inhibited, and size reduction and weight reduction of the pressing/energizing unit 200 can be achieved.

In S45, the pressure regulating valve that is not shown is controlled, and air is supplied into the chamber 370, thereby pressurizing the interior of the chamber 370 to increase the internal pressure to a predetermined pressure (e.g., 5 MPa). Since only the portion of the assembly 100A at the front side with respect to the seat portion 54 is housed within the chamber 370, the volume of the chamber 370 is smaller than that in a configuration for housing the entirety of the assembly 100A. Thus, increasing the internal pressure of the chamber 370 is completed in a short time.

In S50, in a state where the internal pressure of the chamber 370 has been increased to the predetermined pressure, a predetermined voltage is applied to the assembly 100A, and an image of the front end portion of the assembly 100A is captured by using the imaging device that is not shown. Specifically, a relatively high voltage of 30 to 45 kV (kilovolt) is applied multiple times (e.g., several hundred times) between the metal terminal 40 (and the center electrode 20 electrically connected to the metal terminal 40) and the metal shell 50 via the conductive pin 210 and the electrode member 270. Each time the voltage is applied, an image of the front end portion of the assembly 100A is captured. When a defect such as pinhole has not occurred in the insulator 10, since the center electrode 20 and the ground electrode 30 are spaced from each other by a distance larger than the spark discharge gap, spark discharge does not occur. On the other hand, when a defect has occurred in the insulator 10, spark discharge occurs through this defect, and thus spark appears in the captured image of the front end portion of the assembly 100A. At this time, since the cap 260, which is formed from an insulating material, is in close contact with the rear side of the insulator 10, occurrence of a so-called flash over phenomenon in which a current flows between the metal terminal 40 and the metal shell 50 along the surface of the portion of the insulator 10 that is exposed at the rear side, is inhibited. Even if such a flash over phenomenon occurs, spark discharge does not occur at the front side of the assembly 100A. When a flash over phenomenon occurs, a short-circuit occurs between the metal terminal 40 and the metal shell 50, and thus the predetermined voltage cannot be applied between the metal terminal 40 and the metal shell 50. Therefore, when a flash over phenomenon occurs, the dielectric strength of the insulator 10 cannot be appropriately inspected.

In S55, the pressure regulating valve that is not shown is controlled and the internal pressure of the chamber 370 is reduced to the atmospheric pressure.

In S60, the slide support portions 440 are driven and the pressing/energizing unit 200 moves in the rearward direction BD by a predetermined distance. At this time, the conductive pin drive portion 405 controls the conductive pin 210 such that the absolute position of the conductive pin 210 in the axial direction is unchanged. Specifically, the conductive pin drive portion 405 moves the conductive pin 210 relative to the other portion of the pressing/energizing unit 200 in the frontward direction FD by a distance equal to the distance by which the absolute position of the pressing/energizing unit 200 in the axial direction moves in the rearward direction BD due to the movement of the slide support portions 440 in the rearward direction BD.

Figure 8:
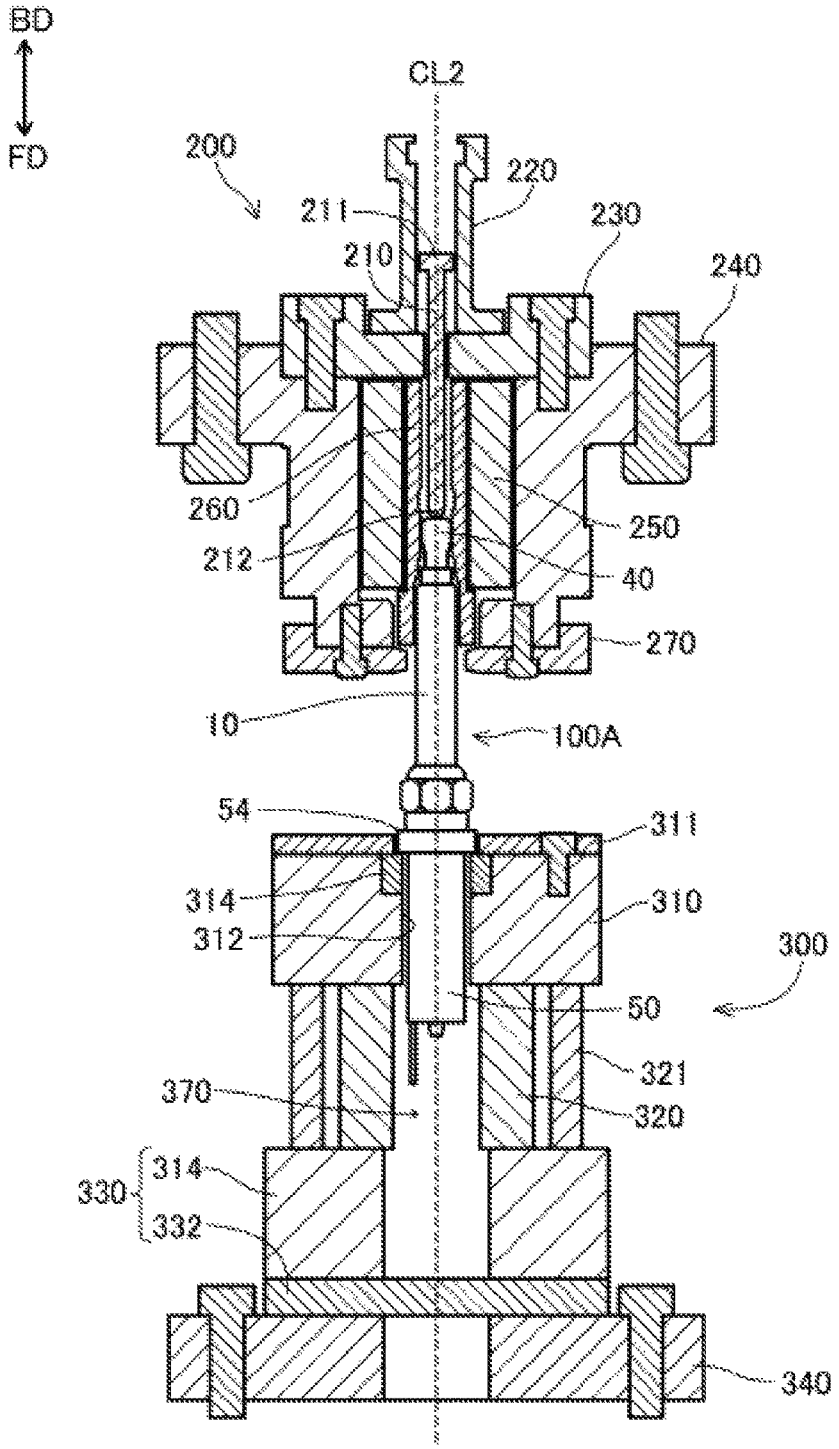
FIG. 8 is an explanatory diagram showing the inspection apparatus and the assembly in a state where S60 is being executed.

FIG. 8 is an explanatory diagram showing the inspection apparatus 500 and the assembly 100A in a state where S60 is being executed. As shown in FIG. 8, when S60 is executed, the pressing/energizing unit 200 moves in the rearward direction BD in a state where the metal terminal 40 is pressed in the frontward direction FD by the conductive pin 210. Because of such motion, the cap 260 moves together with the pressing/energizing unit 200 relative to the insulator 10 in the frontward direction FD with the position of the assembly 100A (the insulator 10) in the axial direction kept unchanged. Accordingly, the cap 260 is detached from the insulator 10. The powder TK of talc is adhered as the lubricant to the portion of the insulator 10 that is covered by the cap 260 (the surface of the rear trunk portion 18) (see S30). Thus, frictional force generated between the cap 260 and the assembly 100A when the cap 260 is moved relative to the assembly 100A is decreased as compared to the case where no lubricant is adhered. Therefore, the cap 260 is easily detached from the assembly 100A.

In S60, after the cap 260 is detached, the pressing/energizing unit 200 further moves in the frontward direction FD and returns to the position in FIG. 2. In S65, the conductive pin drive portion 405 moves the conductive pin 210 relative to the pressing/energizing unit 200 in the rearward direction BD. As a result, the inspection apparatus 500 returns to the state in FIG. 2.

In S70, the dielectric strength of the assembly 100A is evaluated on the basis of the images captured in S50. For example, when the number of images in which spark discharge does not appear, among a plurality of images captured in S50, is equal to or greater than a threshold, the dielectric strength is evaluated as acceptable, and when this number is less than the threshold, the dielectric strength is evaluated as unacceptable. This threshold is determined experimentally; for example, by performing evaluation using an assembly 100A in which an insulator 10 having a defect is assembled in advance.

In S75, bending is performed on the ground electrode 30 of the assembly 100A the dielectric strength of which is acceptable. For example, as shown in FIG. 1, the ground electrode 30 is bent such that the front end surface of the center electrode 20 (the center electrode tip 29) faces one side surface of the front end portion of the ground electrode 30. At this time, the gap between the front end surface of the center electrode 20 and the ground electrode 30 is a spark gap where spark discharge occurs, and is set with a prescribed dimension.

Since bending of the ground electrode 30 is performed after the inspection of dielectric strength as described above, the distance between the ground electrode 30 and the center electrode 20 can be made relatively large in the inspection of dielectric strength. Thus, in the inspection of dielectric strength, a relatively high voltage can be applied.

In S80, the gasket 5 is attached to the front side of the seat portion 54 as shown in FIG. 1. Since the gasket 5 is attached after the inspection of dielectric strength as described, the gasket 5 can be inhibited from being damaged when the assembly 100A is brought into close contact with the pressure vessel 300 in the inspection of dielectric strength. Through the above steps, the spark plug 100 is completed.

According to the embodiment described above, before the tubular cap 260 is attached so as to cover the surface of the portion of the insulator 10 that is exposed at the rear side (i.e., before S40), the lubricant is adhered to the surface of the insulator 10 to be covered by the cap 260, in the lubricant adhering step of S30. As a result, even when the cap 260 is strongly brought into close contact with the insulator 10 at the time of inspection, the cap 260 is easily detached from the assembly 100A in S60 after the predetermined voltage is applied in S50. Therefore, inspection of the insulator 10 of the spark plug 100 can smoothly be progressed while a flash over phenomenon is inhibited from occurring during the inspection.

For example, when the cap 260 is not strongly brought into close contact with the insulator 10 at the time of inspection, the cap 260 is easily detached from the assembly 100A. However, when the predetermined voltage is applied in S50, a flash over phenomenon easily occurs, so that there is a possibility that the inspection cannot be appropriately carried out. Or, it is made necessary to decrease the predetermined voltage to be applied in S50, so that there is a possibility that stricter inspection of dielectric strength cannot be carried out. On the other hand, when the lubricant is not adhered in S30 and the cap 260 is strongly brought into close contact with the insulator 10 at the time of inspection, the predetermined voltage to be applied in S50 can be increased, but it becomes difficult to detach the cap 260 from the assembly 100A. For example, in S60, it becomes impossible to move the conductive pin 210 relative to the other portion of the pressing/energizing unit 200 in the frontward direction FD by the conductive pin drive portion 405, so that it becomes impossible to detach the cap 260 from the assembly 100A. In this case, when the pressing/energizing unit 200 is moved in the rearward direction BD, the assembly 100A is not separated from the cap 260 and the pressing/energizing unit 200 and remains attached to the pressing/energizing unit 200. Accordingly, after S60, an operator needs to perform work for detaching the assembly 100A from the pressing/energizing unit 200 and the cap 260, so that smooth progress of inspection and production of the spark plug 100 is hindered. In addition, when the operator tries to forcedly detach the cap 260, the inner surface of the cap 260 deteriorates and the outer surface of the assembly 100A becomes rough, so that a flash over phenomenon easily occurs. According to the present embodiment, occurrence of such a problem can be inhibited.

The lubricant, used in the lubricant adhering step of S30 is the powder TK of talc. Even when a small amount of the powder TK of talc is adhered to the insulator 10, the powder TK of talc has almost no effect on the performance and the appearance of the spark plug 100. Thus, since the powder TK of talc is used as the lubricant, a step of removing the powder TK of talc can be omitted or simplified. Moreover, since talc has an electrical insulation property, the powder TK of talc does not cause a flash over phenomenon at the time of inspection.

The lubricant adhering step of S30 is a step of bringing the object having the lubricant adhered thereto into contact with the surface of the insulator 10. Thus, the lubricant can easily be adhered to the surface of the insulator 10.

More specifically, as shown in FIG. 6(B), the object having the lubricant adhered thereto is the bag 600 made of cloth in which powder of the lubricant (the powder TK of talc in the present embodiment) is contained. Therefore, the powdery lubricant can easily be adhered to the surface of the insulator 10.

In the present embodiment, in a state where the cap 260 is attached to the insulator 10 in S40, the inner peripheral surface of the cap 260 is in close contact with: substantially the entirety of the outer peripheral surface of the portion of the insulator 10 that is exposed at the rear end; and substantially the entirety of the outer peripheral surface of the cap mounting portion 41. Since the cap 260 is brought into close contact with a wide range of the rear trunk portion 18 and the metal terminal 40 as described above, the voltage that can be applied in S50 can be increased, for example, as compared to the case of using a cap that covers only a narrower portion of the surface of the insulator 10. Since the cap 260 is brought into close contact with the wide range as described above, it can be difficult to detach the cap 260, but in the present embodiment, the cap 260 can easily be detached since the lubricant is adhered to the surface of the portion to be covered by the cap 260 in S30 as described above.

In the present embodiment, since only the part, at the front side, of the assembly 100A is housed in the chamber 370, attaching the assembly 100A to the pressure vessel. 300 and detaching the assembly 100A from the pressure vessel 300 can be performed in a short time. In addition, since the volume of the chamber 370 can be made small, increasing and reducing the internal pressure of the chamber 370 can be performed in a short time. Therefore, the time period required for inspecting dielectric strength and further the time period required for producing the spark plug 100 can be shortened. Moreover, since the volume of the chamber 370 can be made small, the size of the pressure vessel 300 can be reduced.

Since the opening 317 of the chamber 370 is sealed by using the assembly 100A, the number of steps can be decreased as compared to a configuration in which attaching the assembly 100A to the pressure vessel 300 and sealing the opening 317 of the chamber 370 are executed as separate steps.

Since the conductive pin 210 is movably disposed in the insertion hole 290 of the pressing/energizing unit 200, the pressing/energizing unit 200 can be moved in the frontward direction FD to press the assembly 100A, and also the conductive pin 210 can be brought into contact with the metal terminal 40 of the assembly 100A. Thus, the number of steps can be decreased as compared to a configuration in which pressing the assembly 100A by the pressing/energizing unit 200 and bringing the conductive pin 210 into contact with the metal terminal 40 are executed as separate steps. Similarly, since the electrode member 270 is disposed at the front end portion of the pressing/energizing unit 200, the pressing/energizing unit 200 can be moved in the frontward direction FD to press the assembly 100A, and also the electrode member 270 can be brought into contact with the metal shell 50. Therefore, the number of steps can be decreased as compared to a configuration in which a step of pressing the assembly 100A by the pressing/energizing unit 200 and a step of bringing the electrode member 270 into contact with the metal shell 50 to earth the metal shell 50 are executed as separate steps.

B. Modifications (1) In the above embodiment, the lubricant is adhered to the surface of the insulator 10 in the lubricant adhering step of S30. Instead of this step, a lubricant adhering step of S30B shown by a broken line in FIG. 5 may be executed. In S30B in FIG. 5, the lubricant is adhered to an inner surface IS of the cap 260 of the pressing/energizing unit 200 in FIG. 3, that is, an inner surface IS that covers the surface of the insulator 10 when the cap 260 is attached, to the assembly 100A in S40. In this case, for example, a cotton swab having the powder TK of talc adhered as the lubricant thereto is brought into contact with the inner surface IS of the cap 260, thereby adhering the lubricant, to the inner surface IS. The adhesion of the lubricant may be carried out, manually by an operator or may be carried out automatically by a robot. In addition, the adhesion of the lubricant may be carried out automatically, for example, by spraying the lubricant in the form of liquid or powder to the inner surface IS of the cap 260 with an atomizer or a duster.

Both the lubricant adhering step of S30 in the above embodiment and the lubricant adhering step of S30B in the present modification may be executed. That is, before S40 in FIG. 5, the lubricant may be adhered to both the surface of the insulator 10 and the inner surface IS of the cap 260.

(2) In the above embodiment, in S40, the cap 260 is attached to the assembly 100A so as to cover the entirety of the portion of the insulator 10 that is exposed at the rear side with respect to the metal shell 50. Instead, for example, a cap having a smaller axial length than the cap 260 according to the present embodiment may be used so as to cover only a part of the portion of the insulator 10 that is exposed at the rear side with respect to the metal shell 50 (e.g., a part at the front side, a part at the rear side).

The shape and the dimension of the cap 260 can be variously changed. For example, the cap holder 250 may be omitted, and a cap having a shape obtained by integrating the cap holder 250 and the cap 260 of the present embodiment may be used. Generally, the cap is preferably an insulating member including a cylindrical portion into which the insulator 10 is inserted.

(3) In the above embodiment, in the lubricant adhering step of S30, the lubricant is adhered to the entirety of the portion of the insulator 10 that is exposed at the rear side with respect to the metal shell 50. Instead, the lubricant may be adhered to only a part of the portion exposed at the rear side. Generally, the lubricant is preferably adhered to the entirety or a part of the surface of the insulator 10 to be covered by the cap 260. In addition to the surface of the insulator 10, the lubricant may be adhered to the metal terminal 40.

(4) In the above embodiment, the powder TK of talc is used as the lubricant, but another material may be used as the lubricant. For example, powder of a compound including silicon or powder of a resin may be used as the lubricant. In addition, a material in a form different from powder, for example, a material in the form of liquid or gel having an electrical insulation property, such as an oil having an electrical insulation property, may be used as the lubricant.

(5) Depending on the type or the amount of the lubricant to be used, for example, at any time after S60, a step of removing the lubricant from the surface of the insulator 10 or the metal terminal 40, for example, a step of wiping off the lubricant from the surface of the insulator 10 or the metal terminal 40 may be performed.

(6) In the lubricant adhering step of S30, the lubricant is adhered to the surface of the insulator 10 by bringing the bag 600 into contact with the surface of the insulator 10. Instead, the lubricant may be adhered to the surface of the insulator 10 by adhering the lubricant to another object (e.g., a porous body such as a sponge) and bringing this object into contact with the surface of the insulator 10.

(7) In the lubricant adhering step of S30, depending on the type or the like of the lubricant, various changes may be made. For example, when powder of talc is used as in the present embodiment, for example, a step of rubbing an object obtained by compacting the powder of talc, against the surface of the insulator 10 may be adopted. In this case, the object obtained by compacting the powder of talc may be formed in an annular shape, and a step of rubbing the annular object against the surface of the insulator 10 in a state where the insulator 10 is inserted in the hole of the annular object, may be adopted. In addition, when a lubricant in the form of liquid or gel is used, for example, a step of immersing a part, at the rear side, of the assembly 100A (a part, at the rear side, of the insulator 10) into the lubricant stored in a container may be adopted.

(8) In the above embodiment, the portion of the assembly 100A that is housed in the chamber 370 is the portion at the front side with respect to the seat portion 54, but is not limited thereto. At least a part, at the front side, of the assembly 100A, particularly, a portion including a gap 31 (FIG. 1) formed between the inner peripheral surface of the axial hole of the metal shell 50 and the outer peripheral surface of the nose portion 13 of the insulator 10, is preferably housed in the chamber 370.

(9) In the above embodiment, in S60, in order to detach the cap 260 from the insulator 10, the conductive pin 210 is moved relative to the pressing/energizing unit 200 in the frontward direction FD while the pressing/energizing unit 200 is moved in the rearward direction BD by the predetermined distance. Instead, the pressure vessel 300 and the lower fixing plate 410 may be configured to be movable in the axial direction, the assembly 100A and the pressure vessel 300 may be configured to be engageable with each other, and the cap 260 may be detached from the insulator 10 by moving the assembly 100A and the pressure vessel 300 in the frontward direction PD.

(10) in the above embodiment, both the step of bending the ground electrode 30 (S75) and the step of assembling the gasket 5 (S80) are executed after the inspection of dielectric strength (S35 to S70), but may be executed before the inspection of dielectric strength.

(11) In the above embodiment, the lubricant adhering step of S30 is executed on the insulator 10 of the assembly 100A after the assembly 100A is prepared in S10 to S25. Instead, the lubricant adhering step may be executed in the middle of the preparation of the assembly 100A in S10 to S25. For example, the lubricant adhering step may be executed on the insulator 10 that has not been assembled with the metal shell 50, or on the insulator 10 to which the center electrode 20 and the metal terminal 40 have not been assembled. In addition, the lubricant adhering step may be executed on the insulator 10 in a state where the insulator 10 is attached to the pressure vessel 300 in S35. Generally, the lubricant adhering step only needs to be executed before the cap 260 is attached to the insulator 10 in S40.

(12) In the above embodiment, the voltage applied in S50 is the voltage at which spark discharge does not occur at the front side of the assembly 100A. Instead, a high voltage at which spark discharge occurs may be applied. In this case, in a normal state, a flash over phenomenon along the surface of the nose portion 13 occurs, and spark occurs at the front end surface of the insulator 10 (the nose portion 13). Therefore, when spark that has occurred at this portion is observed in a captured image, it can be determined as normal. On the other hand, when a through hole has occurred in the insulator 10 due to a defect such as pinhole, discharge occurs via this through hole, and thus spark does not occur at the front end surface of the insulator 10 (the nose portion 13). Therefore, when spark is not observed at this portion in any captured image, the dielectric strength is determined as unacceptable, that is, it is determined that a defect has occurred in the insulator 10.

(13) The configuration of the inspection apparatus 500 in the above embodiment is merely an example, and may be variously changed. For example, the front end housing portion 320 of the pressure vessel 300 is transparent so that the interior thereof is viewable, but the interior thereof may not be viewable. Similarly, the viewable portion 332 may be configured such that viewing is not possible therethrough. In addition, the upper support portion 310, the central support portion 330, and the lower support portion 340 may be formed from a transparent material such that the entirety of the chamber 370 is viewable from the outside. In addition, the inspection apparatus 500 may be configured such that the upper and lower sides are inverted. In this configuration, for example, first, the rear side of the assembly 100A is inserted into the insertion hole 290 of the pressing/energizing unit 200, and the cap 260 is attached to the assembly 100A. Thereafter, the pressing/energizing unit 200 to which the assembly 100A has been attached is lifted, and the assembly 100A is inserted into the chamber 370 of the pressure vessel 300.

Although the present invention has been described above based on the embodiments and the modified embodiments, the above-described embodiments of the invention are intended to facilitate understanding of the present invention, but not as limiting the present invention. The present invention can be changed and modified without departing from the gist thereof and the scope of the claims and equivalents thereof are encompassed in the present invention.

DESCRIPTION OF REFERENCE NUMERALS

5: gasket
6: ring member
8: plate packing
9: talc
10: insulator
12: axial hole
13: nose portion
15: first reduced outer diameter portion
17: front trunk portion
18: rear trunk portion.
19: flange portion
20: center electrode
25: center electrode body
29: center electrode tip
30: ground electrode
31: gap
40: metal terminal
41: cap mounting portion
42: flange portion
43: nose portion
50: metal shell
51: tool engagement portion
52: mounting screw portion
53: crimp portion
54: seat portion
56: ledge portion
58: compressive deformation portion
59: through hole
60: seal member
70: resistor
80: seal member
100: spark plug
100A: assembly
200: pressing/energizing unit
210: conductive pin
211: flange portion
212: front end portion
220: guide portion
230: first support portion
232: first fixing screw
240: second support portion
242: second fixing screw
250: cap holder
260: cap
270: electrode member
272: edge
274: electrode fixing screw
290: insertion hole
300: pressure vessel
310: upper support portion
311: seal portion holder
312: housing hole
313: through hole
314: seal portion
316: fixing screw
317: opening
320: front end housing portion
321: pillar
330: central support portion
331: main support portion
332: viewable portion
333: communication hole
335: center hole
340: lower support, portion
342: fixing screw
345: observation hole
360: pipe
370: chamber
380: bottom portion
400: voltage application unit
405: conductive pin drive portion
410: lower fixing plate
412: through hole
420: upper fixing plate
430: pillar
440: slide support portion
450: movable shelf
500: inspection apparatus
600: bag
FD: frontward direction
BD: rearward direction
TK: powder of talc Having described the invention, the following is claimed:

1. A method for producing a spark plug, the method comprising:

inspecting an insulator of the spark plug, the inspecting comprising:

preparing an assembly of the spark plug, the assembly including a tubular metal shell, the insulator, a center electrode, a metal terminal, and a ground electrode, the tubular metal shell having a through hole extending in an axial direction, the insulator being partially held within the through hole, the insulator having a rear end that is exposed rearward of a rear end of the metal shell, the insulator having an axial hole extending along the axial direction, the center electrode having a rear end located within the axial hole, the metal terminal having a front end that is located within the axial hole and rearward of the rear end of the center electrode, the metal terminal having a rear end that is exposed rearward of the rear end of the insulator, the ground electrode being joined to the metal shell;

attaching the assembly to a pressure vessel such that a part of the assembly at a front side of the assembly is located within the pressure vessel;

attaching an insulating member including a tubular portion to the assembly to cover at least part of a surface of the rear end of the insulator that is exposed rearward of the rear end of the metal shell;

pressurizing an interior of the pressure vessel;

applying a predetermined voltage between the metal terminal and the metal shell; and detaching the assembly from the insulating member after the predetermined voltage is applied, wherein, prior to the attaching of the insulating member, a lubricant is adhered to one of:

(a)

the at least part of the surface of the rear end of the insulator that is exposed rearward of the rear end of the metal shell; and (b) an inner surface of the insulating member and the at least part of the surface of the rear end of the insulator that is exposed rearward of the rear end of the metal shell.

2. The method for producing the spark plug according to claim 1, wherein the lubricant is powder of talc.

3. The method for producing the spark plug according to claim 1, wherein the adhering the lubricant comprises contacting an object having the lubricant adhered thereto with the one of:

(a) the at least part of the surface of the rear end of the insulator that is exposed rearward of the rear end of the metal shell; and (b) an inner surface of the insulating member and the at least part of the surface of the rear end of the insulator that is exposed rearward of the rear end of the metal shell.

4. The method for producing the spark plug according to claim 3, wherein the object having the lubricant adhered thereto is a bag made of cloth that contains powder of the lubricant.

5. The method for producing the spark plug according to claim 2, wherein the adhering the lubricant comprises contacting an object having the lubricant adhered thereto with the one of:

(a) the at least part of the surface of the rear end of the insulator that is exposed rearward of the rear end of the metal shell; and (b) an inner surface of the insulating member and the at least part of the surface of the rear end of the insulator that is exposed rearward of the rear end of the metal shell.

6. The method for producing the spark plug according to claim 5, wherein the object having the lubricant adhered thereto is a bag made of cloth that contains powder of the lubricant.

* * * * *